US006167936B1

(12) United States Patent
Stover et al.

(10) Patent No.: US 6,167,936 B1
(45) Date of Patent: Jan. 2, 2001

(54) WINDOW ASSEMBLY HAVING ROLLING WINDOW SCREEN ASSEMBLY

(76) Inventors: Jeffrey W. Stover, 5528 Bud Wilson Rd., Gastonia, NC (US) 28056; Dwight L. Ballard, 420 Downey Pl., Gastonia, NC (US) 28052

( * ) Notice: Under 35 U.S.C. 154(b), the term of this patent shall be extended for 0 days.

(21) Appl. No.: 09/387,482

(22) Filed: Sep. 1, 1999

(51) Int. Cl.[7] ..... A47H 1/00
(52) U.S. Cl. ..... 160/27; 160/100
(58) Field of Search ..... 160/27, 28, 100, 160/99, 23.1, 41, 405, 315, 316, 317

(56) References Cited

U.S. PATENT DOCUMENTS

| | | | | |
|---|---|---|---|---|
| 604,620 | * | 5/1898 | Kolb | 160/317 |
| 912,104 | * | 2/1909 | Flora | 160/317 |
| 1,155,546 | * | 10/1915 | Bridges | 160/317 |
| 1,349,438 | * | 8/1920 | Samplawski | 160/100 |
| 1,459,155 | * | 6/1923 | Ioor | 160/315 X |
| 1,810,849 | * | 6/1931 | Nye | 160/315 |
| 1,947,070 | * | 2/1934 | Traut | 160/315 X |
| 2,261,443 | | 11/1941 | McGaw | 156/39 |
| 2,323,295 | | 7/1943 | Brewer | 160/246 |
| 2,379,120 | * | 6/1945 | Turner | 160/27 |
| 2,406,761 | | 9/1946 | Golkowski | 160/290 |
| 2,432,808 | * | 12/1947 | Royak | 160/27 |
| 2,462,520 | | 2/1949 | Marbach | 160/100 |
| 2,514,438 | | 7/1950 | Bardega | 160/30 |
| 2,553,868 | | 5/1951 | Piva, Jr. | 160/30 |
| 2,573,590 | * | 10/1951 | Mosebach | 160/27 |
| 2,605,823 | | 8/1952 | Lockhart | 160/30 |
| 2,825,400 | | 3/1958 | Poulsen | 160/30 |
| 3,008,518 | * | 11/1961 | Hayes | 160/27 |
| 3,173,474 | * | 3/1965 | Wootten | 160/27 |
| 3,470,934 | | 10/1969 | Agnew | 160/27 |
| 3,911,990 | | 10/1975 | Hoover et al. | 160/100 |
| 4,702,297 | | 10/1987 | Van Klompenburg | 160/271 |
| 4,862,942 | | 9/1989 | Johnson | 160/99 |
| 5,505,244 | | 4/1996 | Thumann | 160/23.1 |

FOREIGN PATENT DOCUMENTS

| | | | | |
|---|---|---|---|---|
| 121261 | * | 3/1946 | (AU) | 160/27 |
| 351167 | * | 6/1931 | (GB) | 160/27 |

* cited by examiner

*Primary Examiner*—David M. Purol
(74) *Attorney, Agent, or Firm*—Allen, Dyer, Doppelt, Milbrath & Gilchrist, P.A.

(57) ABSTRACT

A window assembly is provided. The window assembly preferably includes a window frame including a pair of spaced-apart side frame members, an upper end frame member connected to the pair of side frame members along end portions thereof, and a lower end frame member connected to the pair of side frame members along end portions thereof. The lower frame member has a cavity formed therein extending substantially the length of the lower frame member, a cover member overlying the cavity, and an opening formed in the cover member. At least a pair of spaced-apart window guide tracks are provided each of which is connected to a respective one of the side frame members for guiding the opening and closing of a window. The window assembly also includes at least one window mounted to and positioned between the at least a pair of spaced-apart window guide tracks. The window assembly further includes a rolling screen assembly positioned in the cavity of the lower end frame member. The rolling screen assembly has a roller mounted within the cavity and a rolled screen mounted to the roller so that the screen extends and retracts on the roller. The rolled screen is also mounted to the at least one window so that the rolled screen extends and retracts through the opening in the top and is guided into position by the pair of window guide tracks.

24 Claims, 6 Drawing Sheets

Fig. 5.
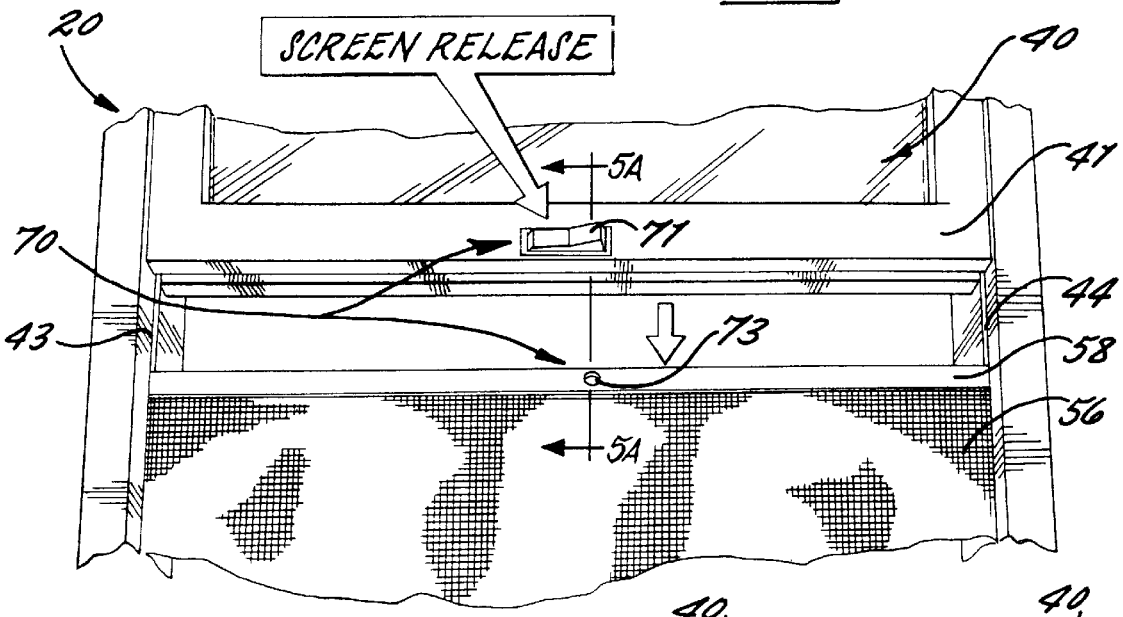
Fig. 6A.
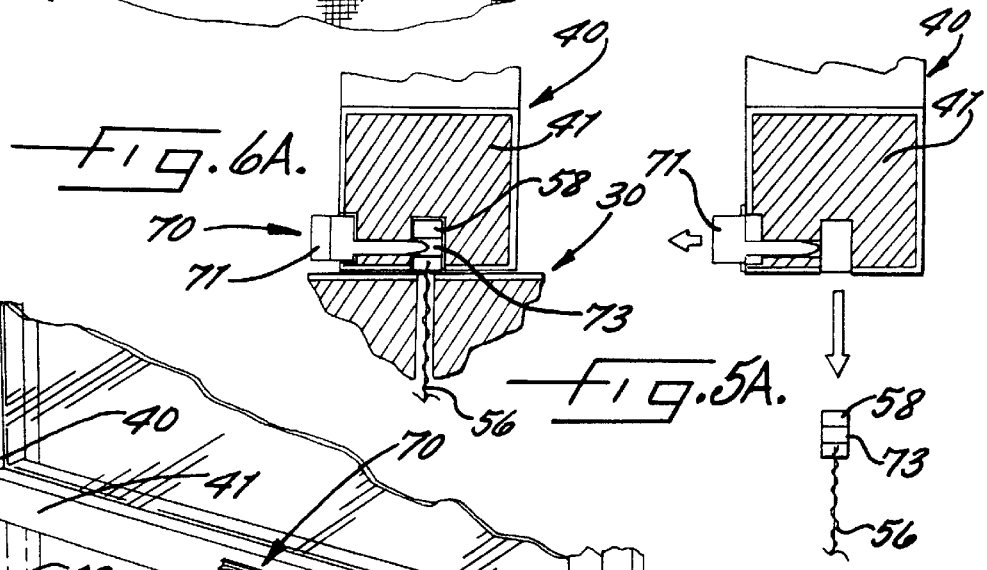
Fig. 5A.
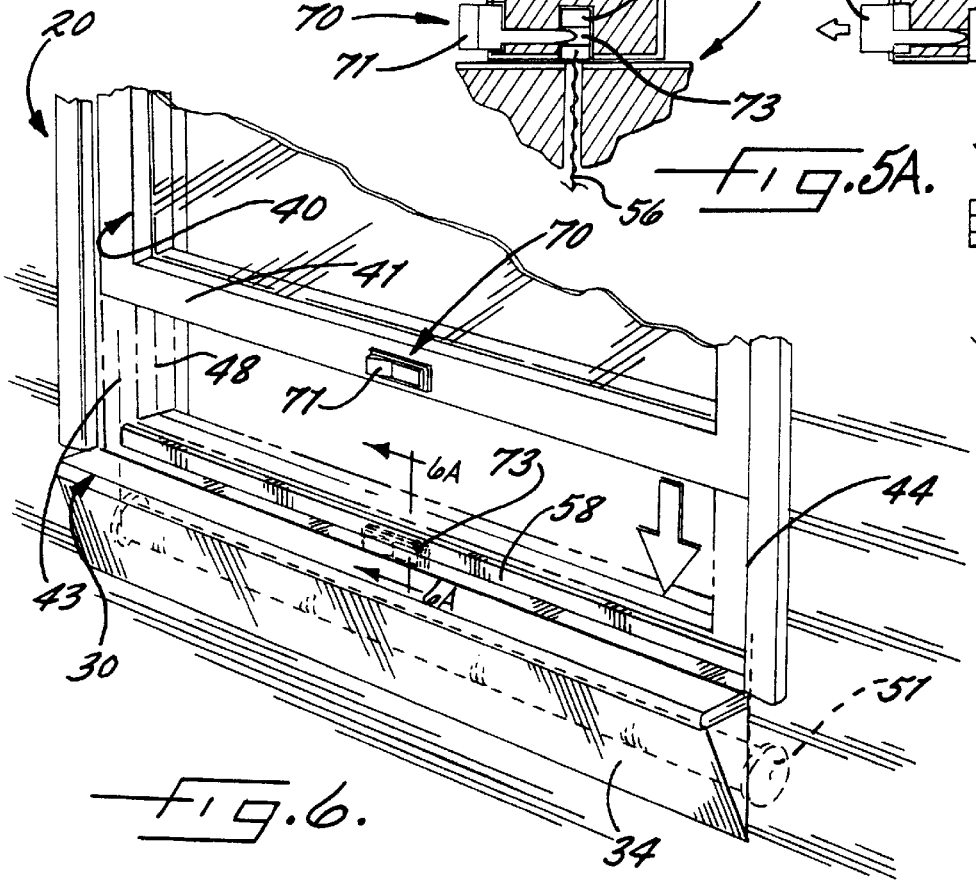
Fig. 6.

20'
22'
32'
55'
35'
10
48'
25'
50'
55'
10
43'
46'
45'
23'
24'
40'
30'

WINDOW ASSEMBLY HAVING ROLLING WINDOW SCREEN ASSEMBLY

FIELD OF THE INVENTION

This invention is related to the building construction industry and more particularly to the field of windows for residential and commercial buildings.

BACKGROUND OF THE INVENTION

Over the years, various types of screens for windows have been developed. These screens conventionally have been generally rectangular in shape, have a screen frame to which screen or mesh material is mounted or secured, and have latches or other fasteners which secure the screen frame within a window frame. These conventional screens often mount to screen tracks which are separately mounted either to the window frame or to the window itself. The latches are opened to raise or lower the screens, usually after the window has been opened. Problems have arisen with these conventional screens in that these type having rectangular frames often get damaged during the construction of a residential or commercial building, require a good deal of extra time and expense for installation, and require extensive time to clean and care for due to its constant exposure to elements to which a window is exposed, e.g., dirt, weather conditions, and pests.

Also, in attempts to solve some of these problems, rolling screen assemblies have been developed for double hung and casement windows which allow a screen to be rolled on a roll assembly or mechanism which attempts to allow the screens to only be placed in position or extended when the window is open. Examples of such rolling screen assemblies can be seen in U.S. Pat. No. 2,261,443 by McGaw titled "Screen," U.S. Pat. No. 2,514,438 by Bardega titled "Combined Sash And Screen," U.S. Pat. No. 2,605,823 by Lockhart titled "Roller Screen," and U.S. Pat. No. 4,702,297 by Van Klompenburg titled "Field Installable Rolling Screen Assembly." A screen of a rolled screen assembly, for example, is less likely to be damaged during new construction because the screen remains on a roll. These conventional rolled screen assemblies, however, also have problems. For example, these screens are usually mounted to an inner or outer ledge of the window sill. These mounting schemes can be cumbersome and unsightly which, in turn, makes the rolled screen assemblies much less desirable by residential and commercial customers. Additionally, separate guide tracks are usually required to guide a rolled screen during raising and lowering or opening and closing of a window. Further, the construction of the window often has to be changed drastically to accommodate such a screen making such a screen less desirable for window manufacturers which are now required to manufacture a custom window and for construction personnel who have to install what is now a special custom window.

SUMMARY OF THE INVENTION

In view of the foregoing, the present invention provides a window assembly having a rolled window screen assembly and associated methods which tracks or follows the window tracks of a conventional double-hung window design. The present invention also advantageously provides a window assembly having a rolled window screen assembly and associated methods which still address or solve the problems associated with the conventional rectangular window screens as set forth above. The present invention additionally advantageously provides a rolled window screen assembly and associated methods which allows window assembly manufacturers to make only minor changes to only small portions of the framing of a conventional double-hung window assembly to accommodate the rolled screen and which allows construction personnel to follow substantially the same installation procedures for installation as conventional double-hung window assemblies. The present invention further advantageously provides a rolled window screen assembly which is more aesthetically pleasing to users of windows in residential and commercial buildings.

More particularly, the present invention provides a window assembly having a window frame which includes an end frame member having a cavity formed therein, a cover member overlying the cavity, and an elongate opening formed in the cover member and overlying the cavity. The window assembly also has at least a pair of spaced-apart window guide tracks connected to the window frame for guiding the opening and closing of a window and at least one window mounted to the at least a pair of spaced-apart window guide tracks and being slidably movable along the guide tracks to an open position wherein end peripheries of the window are spaced apart from the lower frame member and a closed position wherein the end peripheries of the window abuttingly contact the end frame member. The window assembly further has a rolling screen assembly positioned in the cavity of the end frame member. The rolling screen assembly preferably has a roller mounted within the cavity and a rolled screen mounted to the roller so that the screen extends and retracts on the roller. The rolled screen is also mounted to the at least one window so that the rolled screen extends and retracts through the opening in the cover member and is guided into position by the pair of window guide tracks.

According to another aspect of the present invention, the window assembly is preferably a double-hung window assembly which includes a window frame having a substantially rectangular shape. The window frame preferably has a pair of spaced-apart side frame members, an upper end frame member connected to the pair of side frame members along end portions thereof, and a lower end frame member connected to the pair of side frame members along end portions thereof. The lower end frame member has an elongate cavity formed therein extending substantially the length of the lower end frame member, a cover member overlying the cavity, and an elongate opening formed in the cover member. The double-hung window assembly also has at least two pairs of window guide tracks. Each pair is positioned so that each guide track of the pair is connected to a respective one of the side frame members and positioned spaced-apart from the other guide track of the pair for guiding the opening and closing of at least two double hung windows. At least a pair of windows are each respectively mounted to and positioned between at least one of the at least two pair of window guide tracks and being slidably movable along the guide tracks. One of the pair of windows is preferably mounted to be slidably movable to an open position wherein lower peripheries of the window are spaced apart from the lower end frame member and a closed position wherein lower peripheries of the window abuttingly contact the lower end frame member so that the one window defines a lower window when in a closed position. Another one of the pair of windows is mounted to be slidably movable to an open position wherein upper peripheries of the window are spaced apart from the upper end frame member and a closed position wherein upper peripheries of the window abuttingly contact the upper end frame member so that the other one of the pair of windows defines an upper window when in the closed position. A rolling screen assembly is positioned in the cavity of the lower end frame member. The rolling screen assembly has a roller mounted within the cavity and a rolled screen mounted to the roller so that the screen extends and retracts on the roller. The rolled screen is also connected to the lower window so that the rolled screen extends and retracts through the elongate opening in the cover member and is guided into position by the pair of window guide tracks.

The present invention also provides a method of using a window having a rolling screen connected thereto. The method preferably includes moving, e.g., sliding, a window along a pair of spaced-apart, window guide tracks. The pair of window guide tracks are mounted to a window frame. The method also includes moving a rolled screen connected to the window along the same pair of guide tracks to extend and retracted positions during movement of the window. The method can also include the rolled screen being mounted within an end member of the window frame, and the method further including extending the rolling screen through an elongate opening formed in the end member.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 5 is a fragmentary perspective view of a window screen connector of a rolling screen assembly of a window assembly according to the present invention;

FIG. 5A is an enlarged sectional view of a screen window connector releasing a rolled screen taken along line 5A—5A of FIG. 5 of a window assembly according to the present invention;

FIG. 6 is a fragmentary perspective view of a rolled screen being reattached to a window when the window is in a closed position according to the present invention;

FIG. 6A is an enlarged sectional view of a screen window connector capturing a rolled screen taken along line 6A—6A of FIG. 6 of a window assembly according to the present invention;

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation, if used, indicate similar elements in alternative embodiments.

Figure 1:
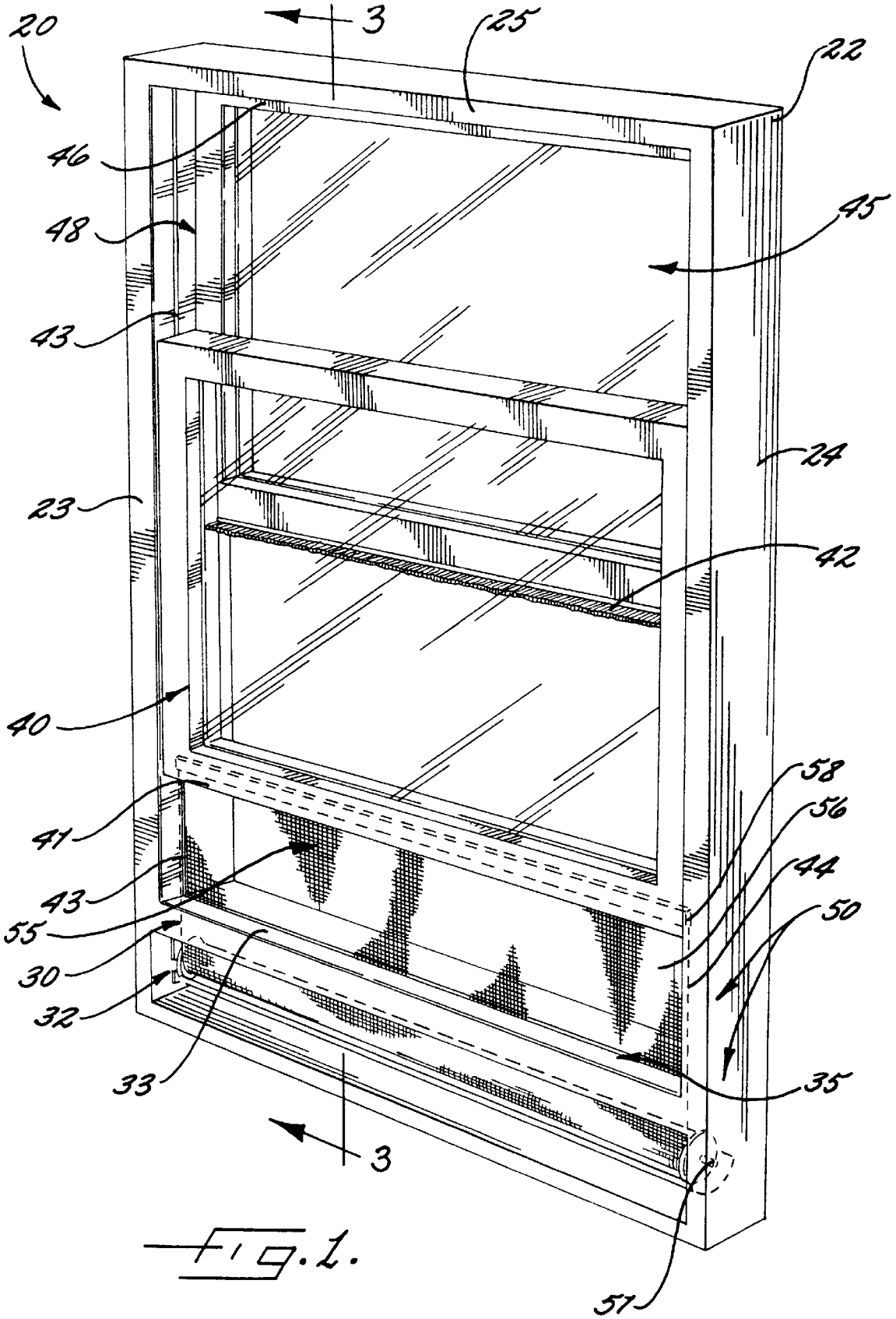
FIG. 1 is a perspective view of a window assembly having a rolling screen assembly according to the present invention.
Figure 2:
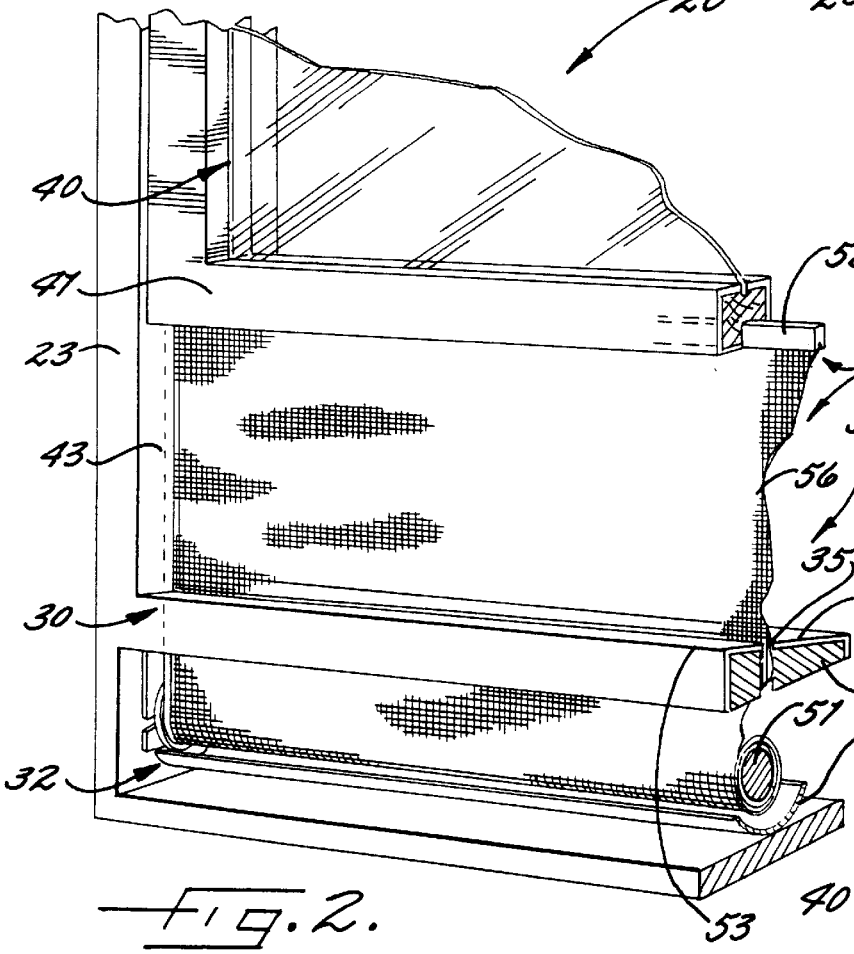
FIG. 2 is a fragmentary enlarged perspective view of a lower window sash and a window sill having a rolled screen assembly positioned therein of a window assembly according to the present invention.
Figure 3:
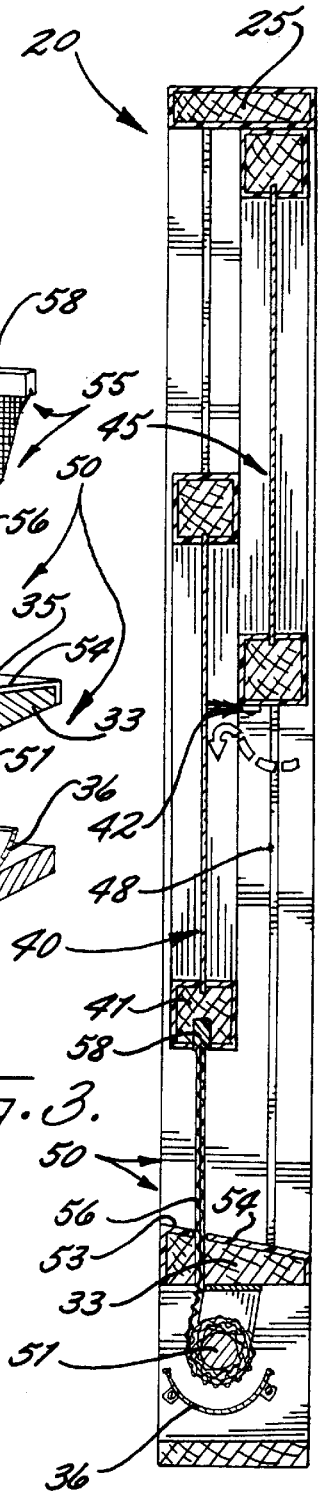
FIG. 3 is a sectional view of a window assembly taken along line 3—3 of FIG. 1 according to the present invention.

FIGS. 1–3 illustrate a window assembly 20 having a rolling screen assembly 50 according to the present invention. The window assembly 20 is preferably a double-hung window assembly such as used for residential or commercial buildings. The window assembly 20 preferably has a window frame 22 which has a substantially rectangular shape and includes a pair of spaced-apart side frame 23, 24 members, an upper end frame member 25 connected to the pair of side frame members 23, 24 along end portions thereof, and a lower end frame member 30 connected to the pair of side frame members 23, 24 along end portions thereof. The lower end frame member 30 preferably has an elongate cavity 32 formed therein extending substantially the length of the lower end frame member 30, a cover member 33 overlying the cavity 32, and an elongate opening 35, e.g., a slit preferably shaped and sized to receive a rolled screen when extending therethrough, formed in the cover member 33. The cover member 33 of the lower end frame member 30 defines at least portions of a window sill against which lower peripheries, e.g., the window sash 41, of a lower window 40 abuttingly contacts when the lower window 40 is in the closed position. A window sealing member 42, e.g., preferably provided by a soft bristle, brush, plastic, or elastomeric sealing member, is preferably connected to lower peripheries of an upper window 45 to seal or form a barrier between the windows to prevent pests or other environmental concerns, e.g., weather, from having a ready path between the windows 40, 45. The lower end frame member 30 further includes an evaporation tray 36 for allowing accumulated moisture to be evaporated therefrom as illustrated (see also FIG. 3).

Figure 4:
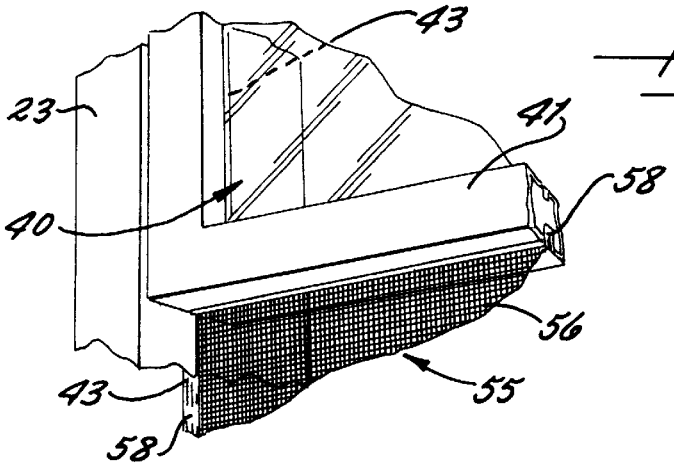
FIG. 4 is a fragmentary perspective view of a rolled screen being guided along a window guide track of a window assembly according to the present invention.
Figure 7:
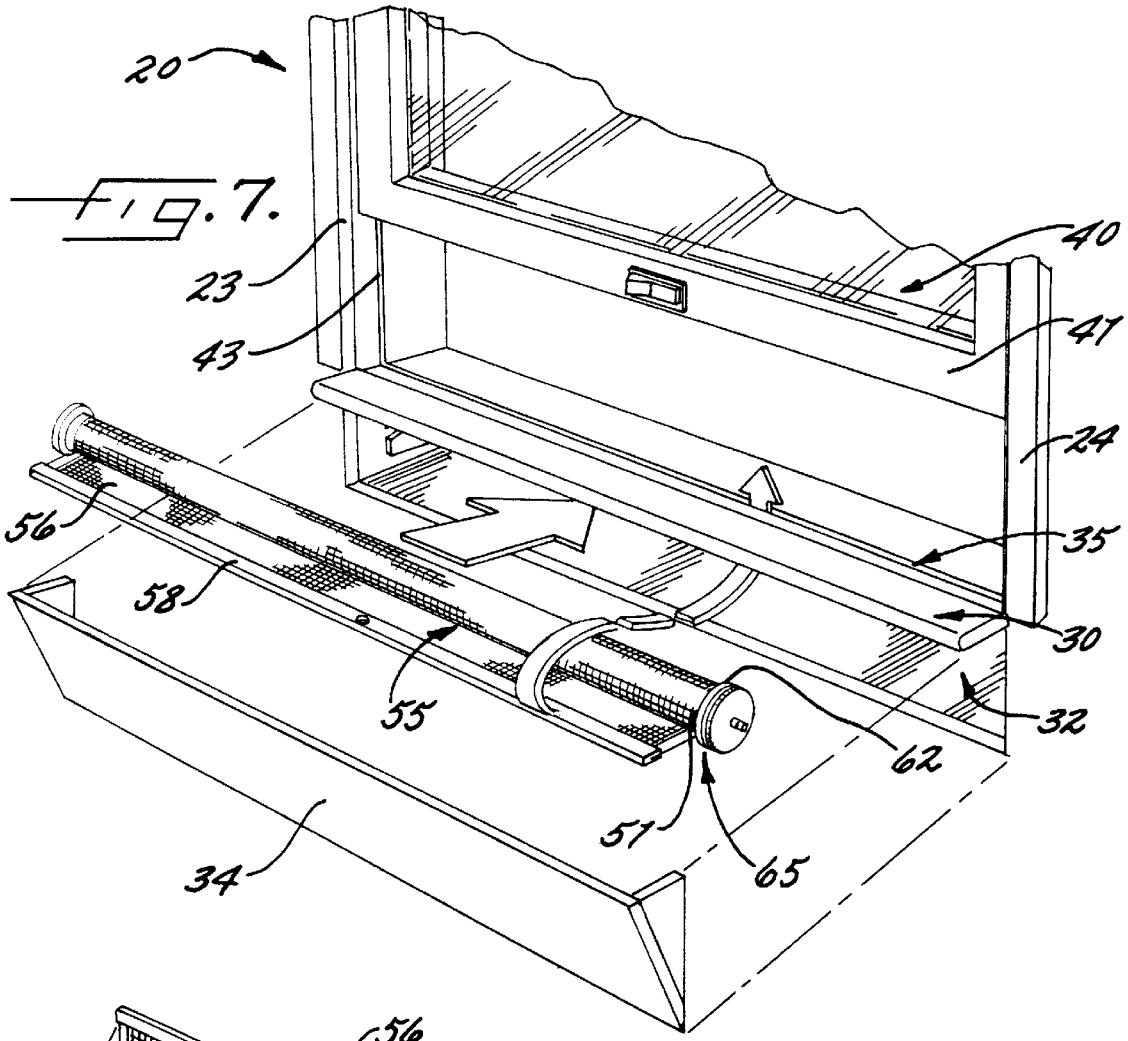
FIG. 7 is a perspective view of a roller of a rolling screen assembly being detached from within a cavity of a lower end of the window frame of a window assembly according to the present invention.
Figure 8:
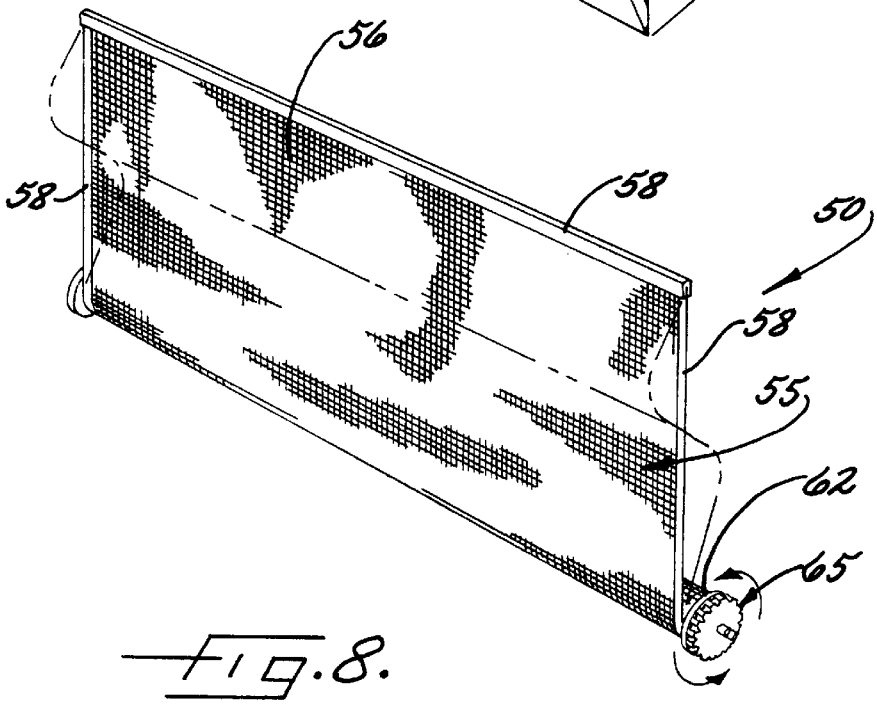
FIG. 8 is a fragmentary perspective view of a portions of a rolling screen assembly of a window assembly according to the present invention.

As perhaps best illustrated in FIGS. 1 and 4, the double-hung window assembly 20 also has two pairs of window guide tracks 43, 44, 48, 49. Each pair of the window guide tracks 43, 44, 48, 49 is positioned so that each guide track of the pair is connected to, e.g., including formed in, a respective one of the side frame members 23, 24 and positioned spaced-apart from the other guide track of the pair for guiding the opening and closing of at least two double hung windows 40, 45. A pair of windows 40, 45 are each respectively mounted to and positioned between at least one 43, 44 of the two pair of window guide tracks and is slidably movable along the guide tracks. One 40 of the pair of windows is mounted to be slidably movable to an open position wherein lower peripheries of the window 40 are spaced apart from the lower end frame member 30 and a closed position wherein lower peripheries 41 of the window 40 abuttingly contact the lower end frame member 30 so that the one window defines a lower window 40 when in a closed position, i.e., based on vertical orientation of the window assembly 20. Another one 45 of the pair of windows is mounted to be slidably movable to an open position wherein upper peripheries 46 of the window 45 are spaced apart from the upper end frame member 25 and a closed position wherein upper peripheries 46 of the window 45 abuttingly contact the upper end frame member 25 so that the other one of the pair of windows defines an upper window 45 when in the closed position.

As shown in FIGS. 2–6, the window assembly 20 also preferably includes a rolling screen assembly 50 positioned in the cavity 32 of the lower end frame member 30. The rolling screen assembly 50 has a roller 51 mounted within the cavity 32 and a rolled screen 55 mounted to the roller 51 so that the screen 55 extends and retracts on the roller 51, e.g., from a bias in a predetermined direction (i.e., rolled or radial direction) or from pressure from the raising or lowering of the window 40. The rolled screen 55 is also mounted to the lower window 40 as illustrated so that the rolled screen 55 extends and retracts through the elongate opening 35 in the cover member 33 and is guided into position by the pair of window guide tracks 43, 44. Notably, the same guide tracks 43, 44 which guide the lower window 40 also advantageously guide the rolled screen 55 as well. This use of the same tracks allows only small portions of a conventional window assembly to be modified to accommodate the rolled screen instead of the conventional rectangular shaped screen which mounts in the window sill. The roller 51 is preferably mounted to an inner surface of the window sill 30 within the cavity 32 so that the rolled screen 55 extends toward the elongate opening 35 at a predetermined angle, e.g., in a range of 5–25 degrees and more preferably about 10–20 degrees, with respect to the inner surface of the window sill 30. The rolled screen 55 preferably includes a screen mesh material 56, e.g., formed of coated nylon or a Teflon coated material as understood by those skilled in the art, and a screen frame 58 attached to outer peripheries of the screen mesh material 56. The screen frame 58 is preferably readily rollable and formed of at least one of the following: a fabric material, an elastomeric material, a polymeric material, or a rubber material, and can also be formed of a combination of these materials together or in separate regions of the frame 58, e.g., upper edge.

As shown in FIGS. 2–3 and 7–8, the rolling screen assembly 50 can also include one or more sealing members 53, 54 positioned to extend along the elongate opening 35 in the cover member 33 of the lower end frame member 30. The sealing member(s) 53, 54 preferably overlies the cover member 33 of the lower end frame member 30 and extends along opposite surfaces of the rolled screen 55 when the rolling screen 55 extends through the elongate opening 35. The sealing members 53, 54 are preferably provided by portions of an overlying sealing layer formed of a material such as vinyl, as understood by those skilled in the art, which overlies the window sill or wood portions thereof. The overlying sealing layer preferably surrounds the elongate opening 35, and the rolled screen 55 preferably abuttingly contacts at least one edge of the overlying sealing layer to assist in removing moisture from the screen 55 during retraction, as well as during extension.

The rolling screen assembly 50 can additionally include at least one biasing member 62, e.g., a roller spring, connected to the roller 51 for biasing the rolled screen 55 in a retracted rolled position and tension adjusting means, e.g., provided by a notched wheel 65 mounted to the roller 51 and the roller spring 62, connected to the at least one biasing member 62 and/or the roller 51 for adjusting the tension in the at least one biasing member 62 and thereby responsively adjust the tension in the rolled screen 55 mounted to the roller 51. The rolled screen assembly 50 can advantageously be readily installed or removed and replaced if desired, e.g., due to screen damage, through the simple removal of a sill member 34.

As perhaps best shown in FIGS. 5, 5A, 6, 6A, and 10 the rolling screen assembly 50 can further include a screen window connector 70 associated with the lower window 40 and the rolled screen 55 for detachablly connecting the rolled screen 55 to a lower end portion of the lower window. The screen window connector 70 preferably is provided by a manual latch 71 connected to the window sash 41 which switches between open and closed positions and an opening 73 formed in the screen frame 58 which cooperates with the latch 71 so that the latch can advantageously release (FIG. 5A) and capture (FIG. 6A) the frame 58 of the rolled screen 55. Other types of connectors can be used as well as understood by those skilled in the art. As shown in FIG. 11, the screen window connector 70 is positioned to release the rolled screen 55 from the lower end portions of the lower window 40 when the rolled screen 55 is in the extended position and pressure is applied against the rolled screen 55 in a direction from within a building toward outside the building.

Figure 9:
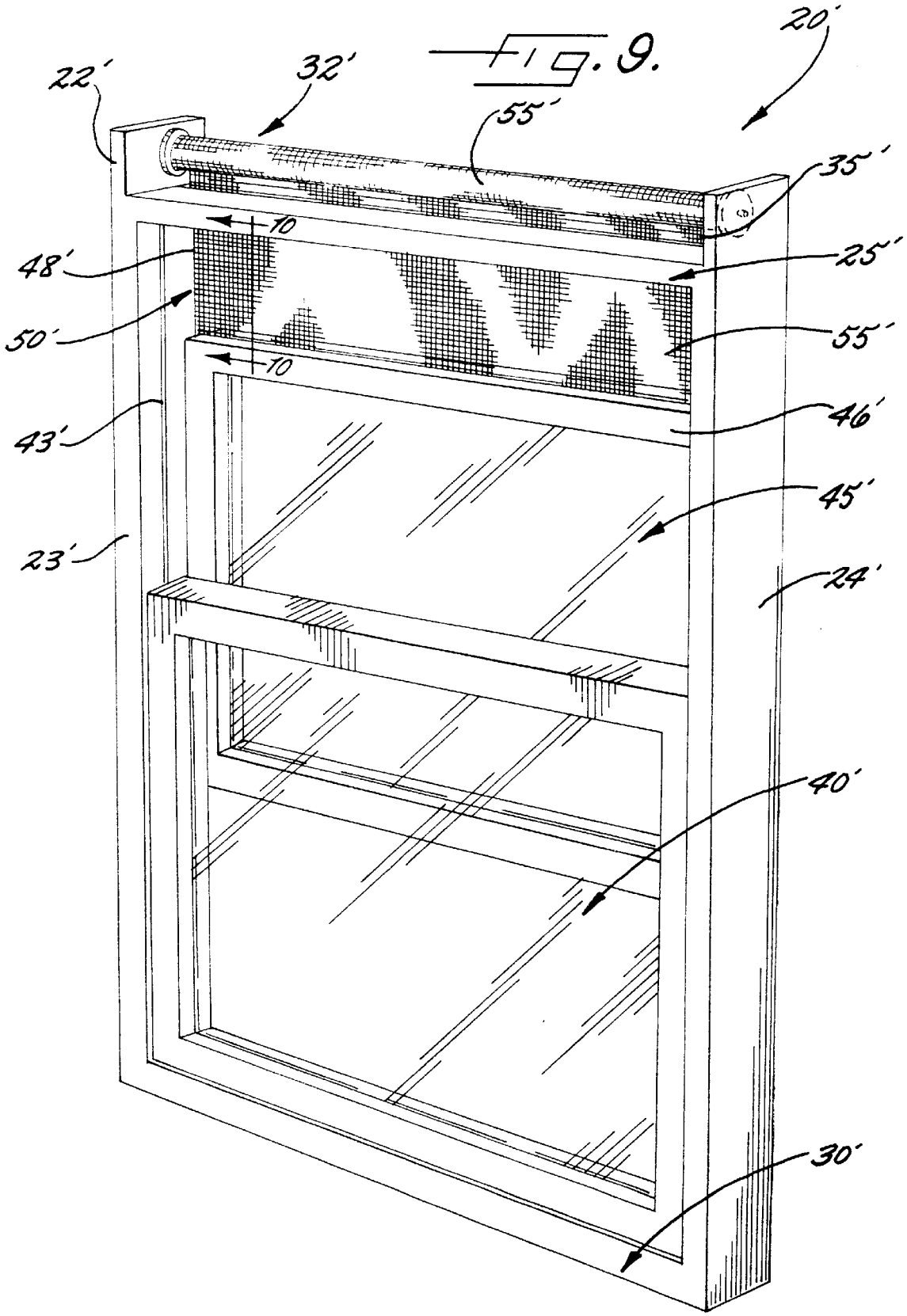
FIG. 9 is a fragmentary perspective view of a window assembly having a rolling screen assembly according to an alternate embodiment of the present invention.
Figure 10:
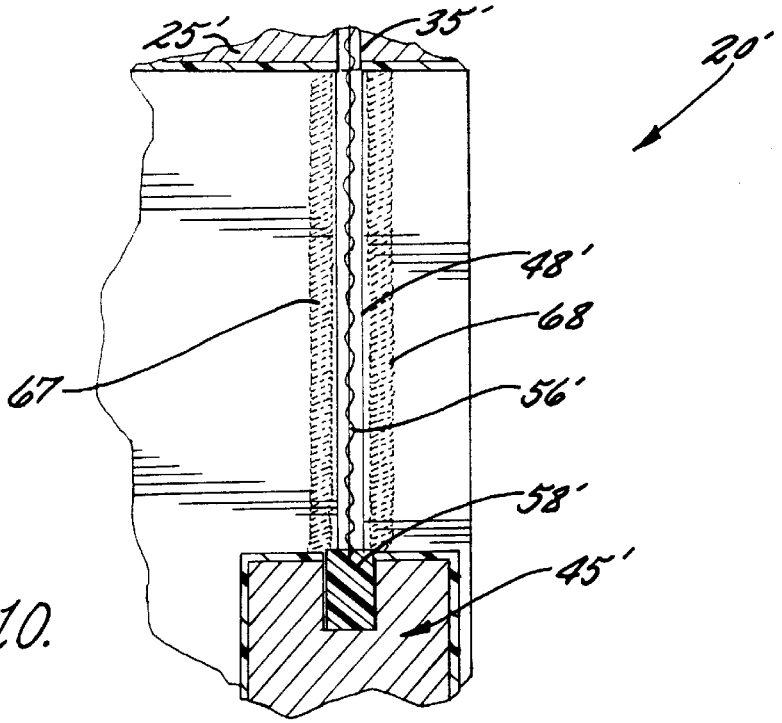
FIG. 10 is a fragmentary sectional view of a window assembly having a rolling screen assembly taken along line 10—10 of FIG. 9 according to an alternate embodiment of the present invention.
Figure 11:
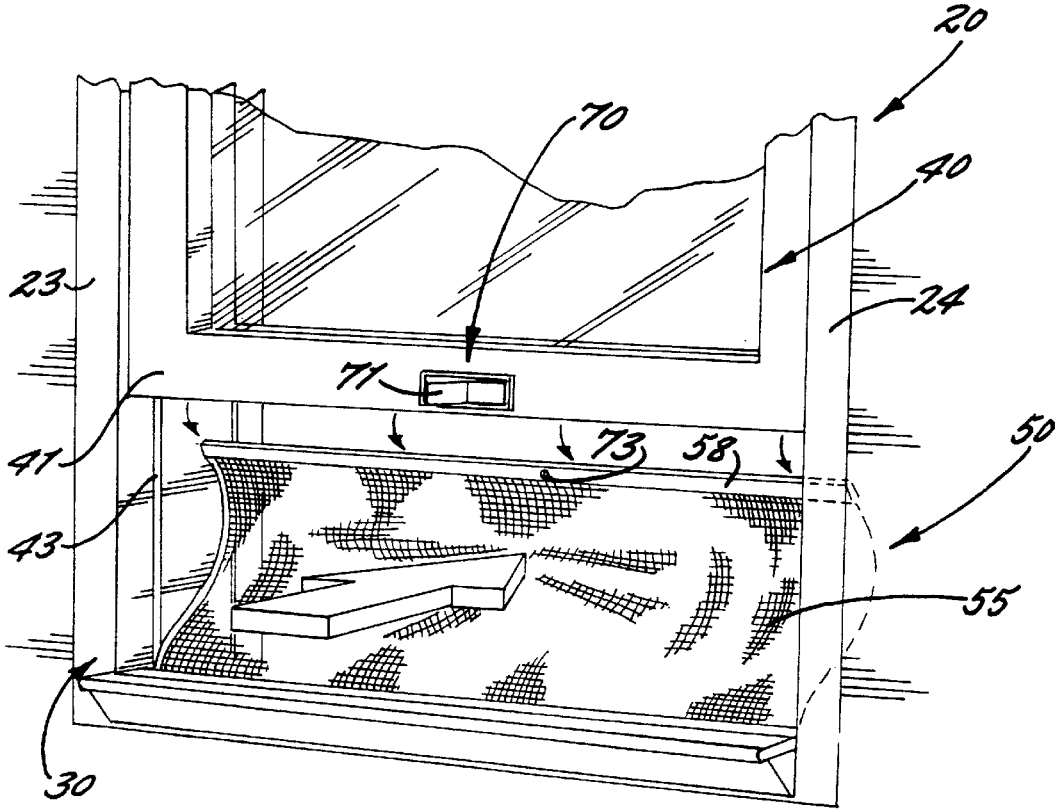
FIG. 11 is a fragmentary perspective view of a window assembly having a rolling screen assembly with a screen being released by outward pressure on the screen from within a building according to a first embodiment of the present invention.

As shown in an alternate embodiment of FIGS. 9–10, the window assembly 20' can also be constructed so that the rolled screen assembly 50' is positioned in the upper end of member 25' of the window frame 22'. As perhaps best shown in FIG. 10, this embodiment preferably also includes a pair of window biasing members 67, 68 which advantageously allow the upper window 45' to have the screen assembly 50' which follows the same guide tracks 48', 49' as the upper window 45'.

As shown in FIGS. 1–11, the present invention also includes methods of using a window 40 or 45 having a rolled screen 55 or 55' connected thereto. The method preferably includes moving, e.g., sliding, a window 40, 45 along a pair of spaced-apart, window guide tracks 43, 44 or 48, 49. The pair of window guide tracks 43, 44 or 48, 49 are mounted to a window frame 22. The method also includes moving a rolled screen 55 connected to the window 40 along the same pair of guide tracks 43, 44 or 48, 49 to extend and retracted positions during movement of the window 40 or 45. The movement of the window 40 is preferably between at least two different locations along the window guide tracks 43, 44. The method can also include the rolled screen 55 being mounted within an end member of the window frame 22, and the method further including extending the rolling screen 55 through an elongate opening 35 formed in the end member 25 or 30 and selectively adjusting the tension in the rolled screen 55 prior to the step of moving the window 40.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A double-hung window assembly for residential or commercial buildings, the double-hung window assemby comprising:

a window frame having a substantially rectangular shape and including a pair of spaced-apart side frame members, an upper end frame member connected to the pair of side frame members along end portions thereof, and a lower end frame member connected to the pair of side frame members along end portions thereof, the lower end frame member having an elongate cavity formed therein extending substantially the length of the lower end frame member, a cover member overlying the cavity, and an elongate opening formed in the cover member;

at least two pairs of window guide tracks, each pair being positioned so that each guide track of the pair is connected to a respective one of the side frame members and positioned spaced-apart from the other guide track of the pair for guiding the opening and closing of at least two double hung windows;

at least a pair of windows each respectively mounted to and positioned between at least one of the at least two pair of window guide tracks and being slidably movable along the guide tracks, one of the pair of windows being mounted to be slidably movable to an open position wherein lower peripheries of the window are spaced apart from the lower end frame member and a closed position wherein lower peripheries of the window abuttingly contact the lower end frame member so that the one window defines a lower window when in a closed position and another one of the pair of windows being mounted to be slidably movable to an open position wherein upper peripheries of the window are spaced apart from the upper end frame member and a closed position wherein upper peripheries of the window abuttingly contact the upper end frame member so that the other one of the pair of windows defines an upper window when in the closed position; and a rolling screen assembly positioned in the cavity of the lower end frame member, the rolling screen assembly having a roller mounted within the cavity, a rolled screen mounted to the roller so that the screen extends and retracts on the roller and mounted to the lower window so that the rolled screen extends and retracts through the elongate opening in the cover member and is guided into position by the pair of window guide tracks, at least one biasing member connected to the roller for biasing the rolled screen in a retracted rolled position, and tension adjusting means connected to the at least one biasing member for adjusting the tension in the at least one biasing member to one of a plurality of preselected levels and thereby responsively adjust the tension in the rolled screen mounted to the roller.

2. A double-hung window assembly as defined in claim 1, wherein the cover member of the lower end frame member defines at least portions of a window sill against which lower peripheries of the lower window abuttingly contact when the lower window is in the closed position, and wherein the roller of the rolling screen assembly is mounted to an inner surface of the window sill within the cavity so that the rolled screen extends toward the elongate opening at an angle in the range of 5–25 degrees from the inner surface of the window sill.

3. A double-hung window assembly as defined in claim 2, wherein said rolling screen assembly includes a pair of sealing members positioned to extend along the elongate opening in the cover member along opposite surfaces of the rolled screen when the rolled screen extends through the elongate opening and positioned to overlie the cover member of the lower end frame member.

4. A double-hung window assembly as defined in claim 3, further comprising a window sealing member connected to lower peripheries of the upper window and extending outwardly therefrom toward an inner surface of the lower window to form a barrier between the upper and lower windows.

5. A double-hung window assembly as defined in claim 4, wherein said rolled screen includes a screen mesh material and a screen frame attached to outer peripheries of the screen mesh material, the screen frame being readily rollable and formed of at least one of the following: a fabric material, an elastomeric material, a polymeric material, and a rubber material, wherein a lower surface of the lower window includes an elongate slot formed therein, and wherein substantially the entire lengthwise extent of the upper peripheries of the screen frame are slidably positioned within the elongate slot when the screen is connected to the lower window.

6. A double-hung window assembly as defined in claim 1, wherein said rolling screen assembly further includes a screen window connector associated with the lower window and the rolled screen for detachably connecting the rolled screen to a lower end portion of the lower window, said screen window connector including screen pressure releasing means for releasing the rolled screen from the lower end portions of the lower window when the rolled screen is in the extended position and pressure is applied against the rolled screen in a direction from within a building toward outside the building.

7. A double-hung window assembly as defined in claim 6, wherein said screen window connector further includes a manual latch connected to the window sash and positioned to switch between open and closed positions so that when the lower end of the window sash contacts upper peripheries of screen frame of the rolled screen the rolled screen connects to the manual latch and when the manual latch is switched by a user the screen frame is released from the window sash.

8. A double-hung window assembly as defined in claim 7, wherein said lower end frame member further includes an evaporation tray for allowing accumulated moisture to be evaporated therefrom, and wherein screen frame includes an opening formed in the screen frame which cooperates with the manual latch so that the latch can readily release and capture the frame of the rolled screen.

9. A window assembly for residential or commercial buildings, the window assembly comprising:

a window frame including a pair of spaced-apart side frame members, a first end frame member connected to the pair of side frame members along end portions thereof, and a second end frame member connected to the pair of side frame members along end portions thereof, at least one of the first and second end frame members having a cavity formed therein extending substantially the length of the at least one frame member, having a cover member overlying the cavity, and an opening formed in the cover member;

at least a pair of spaced-apart window guide tracks, each of the pair of spaced-apart window guide tracks being connected to a respective one of the side frame members for guiding the opening and closing of a window;

at least one window mounted to and positioned between the at least a pair of spaced-apart window guide tracks and being slidably movable along the guide tracks to an open position wherein end peripheries of the window are spaced apart from the at least one end frame member and a closed position wherein end peripheries of the window abuttingly contact the at least one end frame member; and a rolling screen assembly positioned in the cavity of the at least one end frame member, the rolling screen assembly having a roller mounted within the cavity, a rolled screen mounted to the roller so that the screen extends and retracts on the roller and mounted to the at least one window so that the rolled screen extends and retracts through the opening in the top and is guided into position by the pair of window guide tracks, and a pair of sealing members positioned to extend along the elongate opening in the cover member along opposite surfaces of the screen when the rolled screen extends through the elongate opening and positioned to overlie the cover member of the lower end frame member.

10. A window assembly as defined in claim 9, wherein the cover member of the at least one end frame member defines at least portions of a lower window sill against which lower end peripheries of the window abuttingly contact when the window is in the closed position, and wherein the roller of the rolling screen assembly is mounted to an inner surface of the window sill within the cavity so that the rolled screen extends toward the elongate opening at an angle in the range of 5–25 degrees from the inner surface of the window sill.

11. A window assembly as defined in claim 9, further comprising a window sealing member connected to lower peripheries of the upper window and extending outwardly therefrom toward an inner surface of the lower window to form a barrier between the upper and lower windows.

12. A window assembly as defined in claim 10, wherein said rolled screen includes a screen mesh material and a screen frame attached to outer peripheries of the screen mesh material, the screen frame being readily rollable and formed of at least one of the following: a fabric material, an elastomeric material, a polymeric material, and a rubber material, wherein a lower surface of the lower window includes an elongate slot formed therein, and wherein substantially the entire lengthwise extent of the upper peripheries of the screen frame are slidably positioned within the elongate slot when the screen is connected to the lower window.

13. A window assembly as defined in claim 10, wherein the at least one biasing member includes a pair of biasing members each connected to the roller, and wherein said rolling screen assembly further includes tension adjusting means connected to at least one of the biasing members for adjusting the tension in the at least one biasing member to one of a plurality of preselected levels of tension and thereby responsively adjust the tension in the rolled screen mounted to the roller.

14. A window assembly as defined in claim 9, wherein said rolling screen assembly further includes a screen window connector associated with the at least one window and the rolled screen for detachably connecting the rolled screen to a lower end portion of the at least one window, said screen window connector including screen pressure releasing means for releasing the rolled screen from the lower end portions of the lower window when the rolled screen is in the extended position and pressure is applied against the rolled screen in a direction from within a building toward outside the building.

15. A window assembly as defined in claim 14, wherein said screen window connector further includes a manual latch connected to the window sash and positioned to switch between open and closed positions so that when the lower end of the window sash contacts upper peripheries of screen frame of the rolled screen the rolled screen connects to the manual latch and when the manual latch is switched by a user the screen frame is released from the window sash.

16. A window assembly as defined in claim 9, wherein said lower end frame member further includes an evaporation tray for allowing accumulated moisture to be evaporated therefrom, and wherein screen frame includes an opening formed in the screen frame which cooperates with the manual latch so that the latch can readily release and capture the frame of the rolled screen.

17. A window assembly comprising:

a window frame including an upper end frame member having a cavity formed therein, a cover member overlying the cavity, and an elongate opening formed in the cover member and overlying the cavity;

at least a pair of spaced-apart window guide tracks connected to the window frame for guiding the opening and closing of a window;

at least one window mounted to the at least a pair of spaced-apart window guide tracks and being slidably movable along the guide tracks to an open position wherein end peripheries of the window are spaced apart from the upper frame member and a closed position wherein the end peripheries of the window abuttingly contact the upper end frame member; and a rolling screen assembly positioned in the cavity of the end frame member, the rolling screen assembly having a roller mounted within the cavity, a rolled screen mounted to the roller so that the screen extends and retracts on the roller and mounted to the at least one window so that the rolled screen extends and retracts through the opening in the cover member and is guided into position by the pair of window guide tracks, and a pair of sealing members positioned to extend along the elongate opening in the cover member along opposite surfaces of the screen when the rolled screen extends through the elongate opening and positioned to overlie the cover member of the upper end frame member.

18. A window assembly as defined in claim 17, wherein the cover member of the upper end frame member defines at least portions of a window sill against which end peripheries of the at least one window abuttingly contact when the window is in the closed position, and wherein the roller of the rolling screen assembly is mounted to an inner surface of the window sill within the cavity so that the rolled screen extends toward the elongate opening at an angle in the range of 5–25 degrees from the inner surface of the window sill.

19. A window assembly as defined in claim 18, wherein said rolling screen assembly further includes at least one biasing member connected to the roller for biasing the rolled screen in a retracted rolled position, and wherein said rolling screen assembly further includes tension adjusting means connected to the at least one biasing member for adjusting the tension in the at least one biasing member to one of a plurality of preselected levels and thereby responsively adjust the tension in the rolled screen mounted to the roller.

20. A window assembly as defined in claim 19, wherein the rolling screen assembly further includes a screen window connector associated with the at least one window and the rolled screen for detachably connecting the rolled screen to a lower end portion of the at least one window, the screen window connector including screen pressure releasing means for releasing the rolled screen from the lower end portions of the at least one window when the rolled screen is in the extended position and pressure is applied against the rolled screen in a direction from within a building toward outside the building, and wherein the window assembly further comprises a window sealing member connected to lower peripheries of the upper window and extending outwardly therefrom toward an inner surface of the lower window to form a barrier between the upper and lower windows.

21. A rolling screen assembly comprising:

a roller positioned to be mounted within a cavity of an end frame member of a window;

a cover member positioned to form a portion of the end frame member, the cover member having an elongate opening formed therein;

a rolled screen mounted to the roller so that the screen extends and retracts on the roller and positioned to be detachably connected to a lower end portion of a window so that the rolled screen extends and retracts through the elongate opening in the cover member and is guided into position by the same window guide tracks which guide the window;

at least one biasing member connected to the roller for biasing the rolled screen in a retracted rolled position; and tension adjusting means connected to the at least one biasing member for adjusting the tension in the at least one biasing member to one of a plurality of preselected levels and thereby responsively adjust the tension in the rolled screen mounted to the roller.

22. A rolling screen assembly as defined in claim 21, wherein the roller of the rolling screen assembly is mounted to an inner surface of the window sill within the cavity so that the rolled screen extends toward the elongate opening at an angle in the range of 5–25 degrees from the inner surface of the window sill.

23. A rolling screen assembly as defined in claim 21, further including a pair of sealing members positioned to extend along the elongate opening in the cover member along opposite surfaces of the screen when the rolled screen extends through the elongate opening and positioned to overlie the cover member of the upper end frame member.

24. A rolling screen assembly as defined in claim 19, further including a screen window connector associated with the at least one window and the rolled screen for detachably connecting the rolled screen to a lower end portion of the at least one window, the screen window connector including screen pressure releasing means for releasing the rolled screen from the lower end portions of the at least one window when the rolled screen is in the extended position and pressure is applied against the rolled screen in a direction from within a building toward outside the building.

* * * * *